United States Patent [19]

Kennedy

[11] 4,177,629

[45] Dec. 11, 1979

[54] TUNABLE NOISE SUPPRESSION SYSTEM FOR SPINNING MACHINE FIBER COLLECTOR UNITS

[75] Inventor: Harry R. Kennedy, Greer, S.C.

[73] Assignee: Seabrook, Inc., Anderson, S.C.

[21] Appl. No.: 918,573

[22] Filed: Jun. 23, 1978

[51] Int. Cl.[2] ..... D01H 11/00; G10K 11/02

[52] U.S. Cl. ..... 57/1 R; 57/301; 181/241

[58] Field of Search ..... 57/34 R, 1 R, 56, 34.5, 57/1, 301, 304; 181/224, 232, 241, 252, 256, 264, 267, 226, 257, 286; 15/326

[56] References Cited

U.S. PATENT DOCUMENTS

| | | | |
|---|---|---|---|
| 2,514,344 | 7/1950 | Slaymaker et al. | 181/241 |
| 2,908,029 | 10/1959 | Furst | 57/34.5 X |
| 3,330,379 | 7/1967 | Cook | 181/224 |
| 3,391,528 | 7/1968 | Schuckelford | 57/304 |
| 3,750,839 | 8/1973 | McNabney | 181/226 X |
| 3,762,143 | 10/1973 | Stewart | 57/56 |
| 3,926,665 | 12/1975 | Harrop et al. | 57/301 X |
| 3,986,328 | 10/1976 | Harrap | 57/56 |
| 4,024,698 | 5/1977 | Weiss | 57/1 R X |
| 4,031,690 | 6/1977 | Thomas et al. | 57/1 R |
| 4,091,892 | 5/1978 | Hehmann et al. | 181/224 X |

*Primary Examiner*—Donald Watkins
*Attorney, Agent, or Firm*—B. P. Fishburne, Jr.

[57] ABSTRACT

To assist textile mills in complying with Government regulation of noise levels, a tunable noise suppression device or muffler is connected to the exhaust of the fiber collection box of a pneumatic spun fiber collection system of a spinning machine. The device is adjustable to reduce exhaust noise to an acceptable level while maintaining the necessary degree of suction in the fiber collection system. The noise suppression device has the ability to nullify the most predominant noise generating sound wave lengths and/or predominant noise frequencies through tuning, whereby it is unnecessary to construct various sizes and configurations of the suppression device for use on different textile machines which may possess differing predominant noise frequencies.

7 Claims, 3 Drawing Figures

TUNABLE NOISE SUPPRESSION SYSTEM FOR SPINNING MACHINE FIBER COLLECTOR UNITS

BACKGROUND OF THE INVENTION

The use of pneumatic spun fiber collecting systems on spinning frames and similar textile machines has been standard procedure in the textile industry for a long time. In such fiber collection systems, ducting extends throughout the length of the spinning frame with inlets for loose fibers under each delivery position along the machine. A motor driven fan creates suction in the ducting system and fibers are drawn into the system and delivered to a large collection box at one end of the spinning frame equipped with a screen which prevents the exhausting of loose fibers back into the spinning room. Such fiber collection systems are very well known and are disclosed by U.S. Pat. Nos. 2,431,762; 2,672,733; 2,774,061; 2,812,632; and others.

The most commonly used pneumatic fiber collection systems for spinning machines, particularly the exhausts thereof, are extremely noisy, commonly exceeding 96 decibels on the "A" Scale Fast Response. Existing Federal laws administered under the Occupational Safety Health Administration (OSHA) require maintaining the noise level below 90 decibels on the "A" Scale Fast Response. It is the primary objective of this invention to meet this requirement without rendering the existing pneumatic fiber collection system ineffective due to the creation of back pressure in the system.

Prior art attempts to suppress the noise of pneumatic fiber collection systems on spinning frames have tended to reduce the effective suction in the systems to such low levels that the systems are substantially useless. Additionally, because various systems or units possess differing predominant noise frequencies, it has not been possible to devise a muffler or noise suppressor which can be universally employed on most or all spinning frames, and it is not economically feasible to construct a customized noise suppressor of a given size and configuration for each machine.

The present invention has the ability to overcome these main problems of the prior art through the provision of an easily adjustable or tunable noise suppression device which can be fitted to the exhaust of any spinning machine fiber collection box to maintain the level of noise generated by such exhaust at acceptable levels while maintaining the necessary degree of suction in the pneumatic fiber collection system for full and efficient operation. The adjustable noise suppression device embodied in the invention can be variably tuned in a very convenient manner to reduce noise generated by a predominant sensitive wave length present at the exhaust of any given pneumatic fiber collection system. The tuning or adjusting of the device is also effective to increase or decrease the degree of suction in the system so that the suction does not fall below acceptable levels because of back pressure created by the suppression device. In this respect, the invention is extremely versatile in its adaptability to a wide variety of textile machines which possess varying noise characteristics, thus obviating the necessity for expensive customizing of equipment.

To comply with the duty to disclose known prior art under 37 C.F.R. 1.56, the following prior U.S. Pat. Nos. are made of record herein:

2,112,608;

2,514,344;
2,708,829;
2,958,387;
3,219,143;
3,435,911;
3,438,522;
3,895,686;
3,986,325;
4,015,683; 4,024,698.

DETAILED DESCRIPTION

Figure 1:
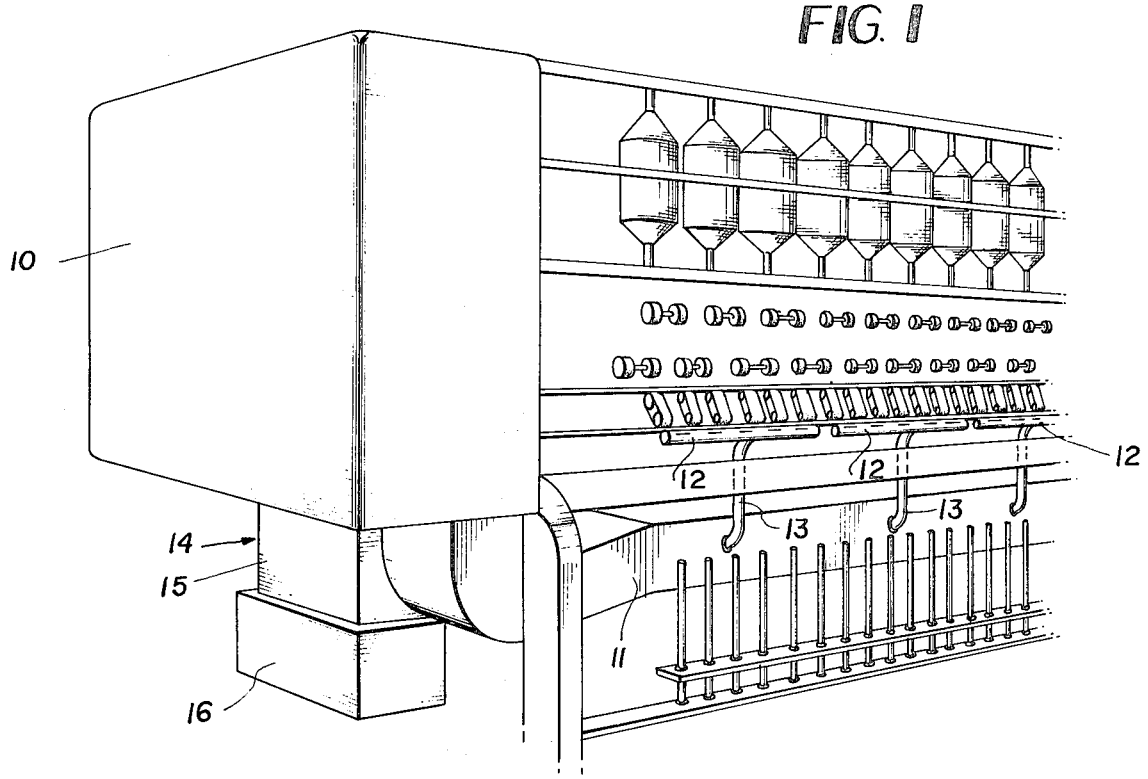
FIG. 1 is a fragmentary perspective view of a typical spinning machine equipped with the invention, parts omitted for simplicity.

Referring to the drawings in detail, wherein like numerals designate like parts, a conventional spinning frame is shown in FIG. 1 having a loose fiber collection box 10 mounted at one end thereof, said box receiving fibers from a duct 11 which extends for the entire length of the spinning frame, with a number of slotted fiber intake heads 12 positioned under the delivery rolls of the drafting system of the spinning frame. The several intake heads 12 communicate with the main suction duct 11 through conduits 13, as illustrated. A partial vacuum is created in the fiber delivery duct 11 by a motor driven fan, not shown, associated with the collection box 10. In the particular embodiment of the loose fiber collection system shown in FIG. 1, the screened or filtered exhaust for the system is located at the bottom of the box 10. In this connection, it should be understood that the invention is applicable not only to the fiber collection system for a spinning frame shown in FIG. 1 but to other similar systems having a somewhat different configuration such as an exhaust opening through a side wall of the collection box rather than through the bottom thereof.

Figure 2:
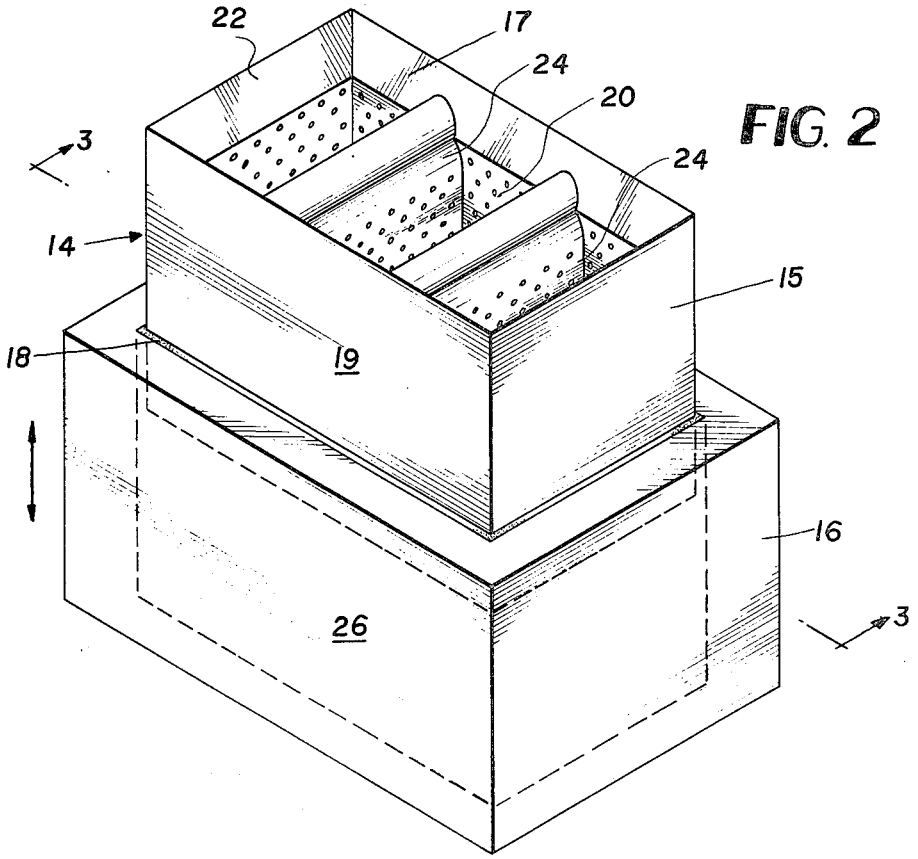
FIG. 2 is a perspective view of a tunable noise suppression device or muffler in accordance with the invention.
Figure 3:
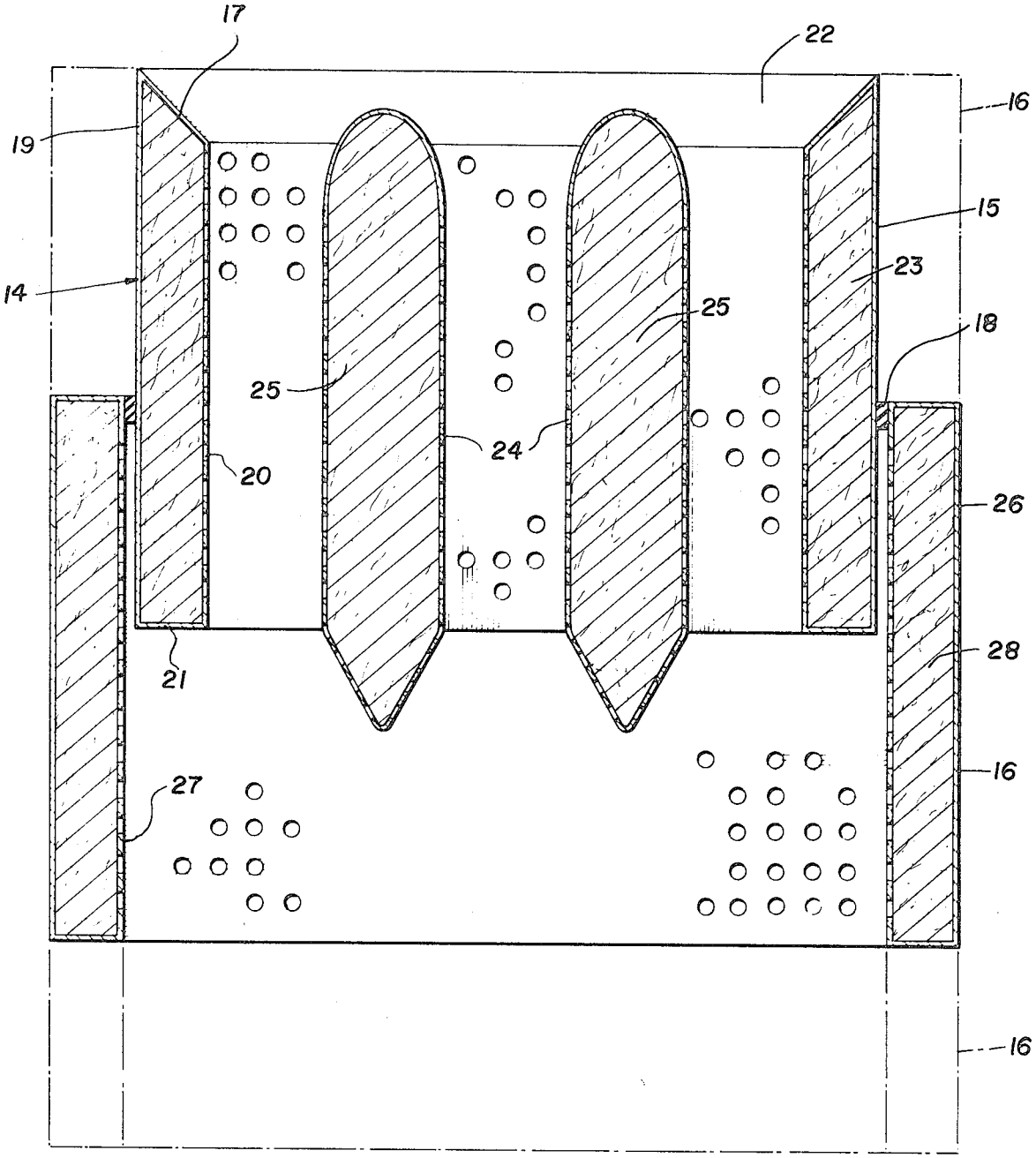
FIG. 3 is an enlarged vertical section through the device taken on line 3—3 of FIG. 2.

The main subject matter of the invention shown in detail in FIGS. 2 and 3 comprises an easily adjustable or tunable noise suppressing device or muffler 14 formed in two telescopically interfitting rectangular sections 15 and 16. In the embodiment shown, the device 14 is coupled in registration with the bottom exhaust outlet of the collection box 10 by conventional latches, screws or other fastening means, not shown. The flared mouth 17 of the noise suppressor section 15 is held in close registration with the exhaust outlet and may, if desired, be sealed thereagainst by suitable gasketing material.

The two sections 15 ad 16 are preferably rectangular in cross section but may, in some instances, have different shapes. The smaller section 15 is fixed relative to the collection box 10 in the illustrated embodiment while the larger lower section 16 is telescopically adjustable on the section 15. A common resilient type gasket 18 fixed to the movable section 16 forms an air seal between the two sections of the tunable muffler and also forms a means of easy adjustment upwardly or downwardly for the movable section 16, as well as a support for the movable section 16 due to friction.

The stationary muffler section 15 has an imperforate outer shell 19 of sheet metal and an inner wall or liner 20 of perforated sheet metal in spaced parallel relation to the outer shell and joined to the latter at the bottom of the stationary section 15 by a narrow continuous imperforate bottom wall 21. Similarly, at the mouth 17 of muffler section 15, the two walls 19 and 20 are fixedly connected by a narrow inclined continuous wall 22. The space between the outer shell 19 and perforated liner 20 is filled with acoustical fiberglass 23 or equivalent material to further suppress noise generated in the air stream exhausting from the box 10.

The fixed muffler section 15 further comprises divider baffles 24 having perforated side walls and being fixedly mounted within the muffler section 15 in spaced parallel relationship with each other and with the end walls of the section 15. The perforated baffles 24 are also filled as at 25 with acoustical fiberglass or the like. The construction of the muffler section 15 provides for maximum noise suppression in the exhaust air passing therethrough from the box 10 without substantially impeding the free flow of the exhaust air and therefore without developing excessive back pressure in the pneumatic fiber collection system which could render the system ineffective.

The telescopically adjustable fine tuning section 16 of the noise suppressing device is similarly constructed with an imperforate outer shell 26 and a spaced perforated interior wall or liner 27. The tuning section 16 is open-ended and unobstructed internally so that it can be freely adjusted telescopically on the fixed section 15. The tuning section 16 is filled with acoustical fiberglass 28 between its shell 26 and liner 27.

In use, with the two part adjustable noise suppressing device installed on the box 10 as described, the movable section 16 is adjusted up or down on the fixed section 16 to suppress exhaust noise generated by a predominant sensitive wave length, the same adjustment or tuning of the device also serving to increase or decrease somewhat the degree of suction in the fiber collection system by increasing or decreasing back pressure created by the muffler. By adjusting these factors, the device can be fine tuned to regulate exhaust noise within acceptable limits defined by law and without reducing system suction below fully effective levels for the proper operation of the same. This tuning capability of the device enables its use on textile machines which have varying predominant noise frequencies, whereby it is unnecessary to customize a muffler for each separate textile machine and the same device with proper tuning will function to suppress noise on a wide range of machines.

The advantages of the invention over the prior art should now be apparent. The invention is characterized by simplicity and economy of construction and convenience and efficiency of operation.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a textile machine of the class having a pneumatic loose fiber collection system including a loose fiber collection box having an exhaust outlet, the combination with said loose fiber collection box of an exhaust noise suppression device mounted in communication with said exhaust outlet and including at least a pair of interfitting sections which are adjustable one relative to the other so that said device can be tuned to suppress predominant noise frequencies, said interfitting sections being sleeve-like and being telescopically engaged, a resilient gasket disposed between said telescoping sections of the device to form an air seal therebetween and to also form a frictional connection between said sections whereby they will remain in selected adjusted positions, and each of said telescoping sleeve-like sections being double-walled with the inner wall thereof perforated, and acoustical insulating material filling the spaces of said sections between their inner and outer walls.

2. In a textile machine as defined in claim 1, and the smaller of said telescoping sleeve-like sections having a mouth adapted for registration with the exhaust outlet of said fiber collection box.

3. In a textile machine as defined in claim 1, and said telescoping sleeve-like sections being of rectangular formation.

4. In a textile machine as defined in claim 3, and said exhaust outlet being in the bottom of the loose fiber collection box and said noise suppression device being dependingly secured to said bottom.

5. In a textile machine as defined in claim 2, and hollow perforated wall divider baffle means in said smaller section of the device extending substantially parallel to the exhaust air flow axis of the device and being filled with acoustical insulating material.

6. In a textile machine as defined in claim 5, and said baffle means comprising at least a pair of spaced parallel baffles symmetrically disposed in the interior of said smaller section of the device.

7. In a textile spinning machine of the class having a pneumatic loose fiber collection system including a loose fiber collection box having an exhaust outlet, the improvement comprising a tunable exhaust noise suppression device mounted in registration with said exhaust outlet and including a pair of telescopically interfitting and relatively telescopically adjustable sections, each of said sections having acoustical insulating walls.

* * * * *